US008192584B2

(12) United States Patent
Murakami

(10) Patent No.: US 8,192,584 B2
(45) Date of Patent: Jun. 5, 2012

(54) PAPERMAKING BELT

(75) Inventor: Tetsuya Murakami, Hirakata (JP)

(73) Assignee: Yamauchi Corporation, Osaka (JP)

( * ) Notice: Subject to any disclaimer, the term of this patent is extended or adjusted under 35 U.S.C. 154(b) by 371 days.

(21) Appl. No.: 12/520,413

(22) PCT Filed: Dec. 12, 2007

(86) PCT No.: PCT/JP2007/073928

§ 371 (c)(1),
(2), (4) Date: Jun. 19, 2009

(87) PCT Pub. No.: WO2008/078557

PCT Pub. Date: Jul. 3, 2008

(65) Prior Publication Data

US 2010/0089543 A1 Apr. 15, 2010

(30) Foreign Application Priority Data

Dec. 22, 2006 (JP) ..... 2006-346670

(51) Int. Cl.
*D21F 3/02* (2006.01)
*B32B 5/02* (2006.01)

(52) U.S. Cl. ..... 162/358.4; 162/901; 442/66

(58) Field of Classification Search ..... 162/306, 162/358.2, 358.4, 900–903; 442/59, 64–68, 442/70–72, 74

See application file for complete search history.

(56) References Cited

U.S. PATENT DOCUMENTS

| | | | | |
|---|---|---|---|---|
| 4,254,010 | A * | 3/1981 | Mizuno et al. | 523/213 |
| 4,559,258 | A | 12/1985 | Kiuchi | |
| 5,549,967 | A | 8/1996 | Gstrein | |
| 5,601,877 | A | 2/1997 | Miller et al. | |
| 6,447,648 | B1 * | 9/2002 | Slagowski et al. | 162/358.4 |
| 7,090,747 | B2 * | 8/2006 | Watanabe et al. | 162/358.4 |
| 2002/0060052 | A1 | 5/2002 | Best | |
| 2005/0208288 | A1 | 9/2005 | Li et al. | |

FOREIGN PATENT DOCUMENTS

| | | | |
|---|---|---|---|
| EP | 1127976 | A2 | 8/2001 |
| JP | 1298292 | A | 12/1989 |

(Continued)

OTHER PUBLICATIONS

International Search Report, PCT/JP2007/073928, Feb. 5, 2008, pp. 11-17.

*Primary Examiner* — Eric Hug
(74) *Attorney, Agent, or Firm* — Ditthavong Mori & Steiner, P.C.

(57) ABSTRACT

A papermaking belt 10 includes: a base material layer 11 including longitudinal and lateral yarns; a back-surface-side resin layer 12 which is provided on a back surface side of the base material layer, and at least a part of which has impregnated into the base material layer from the back surface side of the base material layer; a first resin layer 13 which has a relatively low viscosity, and has impregnated into the base material layer 11 from a front surface side of the base material layer 11; and a second resin layer 14 which contains chopped fibers 15 in a dispersed state, has a higher viscosity than that of the first resin layer 13, and is provided on a front surface side of the first resin layer 13.

6 Claims, 1 Drawing Sheet

FOREIGN PATENT DOCUMENTS

| | | | |
|---|---|---|---|
| JP | 375673 | B2 | 12/1991 |
| JP | 4119191 | A | 4/1992 |
| JP | 1077593 | A | 3/1998 |
| JP | 2889341 | B2 | 2/1999 |
| JP | 2001-089990 | A | 4/2001 |
| JP | 2001-89991 | A | 4/2001 |
| JP | 2002146694 | A | 5/2002 |
| JP | 2003171891 | A | 6/2003 |
| JP | 2004-124274 | A | 4/2004 |
| JP | 2005146448 | A | 6/2005 |
| JP | 2007131986 | A | 5/2007 |
| WO | 9807926 | A2 | 2/1998 |
| WO | WO 2005/090429 | A1 | 9/2005 |
| WO | 2006020097 | A1 | 2/2006 |

* cited by examiner

PAPERMAKING BELT

TECHNICAL FIELD

The present invention generally relates to a papermaking belt, and more particularly, to a shoe press belt for use in a dehydrating process of a wet paper web.

BACKGROUND ART

Examples of papermaking belts include a shoe press belt, a calendar belt, a transfer belt, and the like.

General required characteristics for papermaking belts such as a shoe press belt include strength, crack resistance, abrasion resistance, flexibility, and impermeability to water, oil, gas, and the like. Polyurethane, which is obtained by a reaction between a urethane polymer and a curing agent, has been commonly used as a material having these characteristics.

In a papermaking technique, it has been known to form a multiplicity of drain grooves, extending along a travel direction of a wet paper web, in the outer surface of a belt in order to drain water squeezed from the pressed wet paper web. For example, U.S. Pat. No. 4,559,258 describes a papermaking machine belt having such drain grooves.

Japanese Patent No. 2889341 discloses a dehydrating press belt. The dehydrating press belt disclosed in this patent includes a base fabric layer, an intermediate elastic layer formed on at least one surface side of the base fabric layer, a front-surface elastic layer formed outside the intermediate elastic layer, and a back-surface elastic layer formed on the other surface side of the base fabric layer, and is formed by integrally bonding these layers together. The intermediate elastic layer is formed before the front-surface elastic layer in order to remove air remaining in the base fabric layer. In an embodiment disclosed in this patent, the front-surface elastic layer, the intermediate elastic layer, and the back-surface elastic layer are made of polyurethane. Moreover, the shore A hardness of the front-surface elastic layer is higher than that of the back-surface elastic layer, and the shore A hardness of the intermediate elastic layer has an intermediate value between those of the front-surface elastic layer and the back-surface elastic layer. The front-surface elastic layer contains no fiber inside.

Japanese Patent Publication No. H03-75673 of examined applications discloses a blanket for an extended nip press. In the blanket disclosed in this publication, a blanket main body is made of polyurethane having randomly oriented fibers, in order to prevent layer separation and creep of a band-shaped main body while the blanket is in use.

Japanese Patent Publication No. H10-77593 of unexamined applications discloses a blanket with parallel grooves for use in a wide nip press. In the blanket disclosed in this publication, a polyurethane layer is formed on a woven fabric or cotton cloth base formed in a loop. The polyurethane layer has a multiplicity of thin fibers extending in a cross-machine direction. The fibers improve the strength of the polyurethane layer.

In the dehydrating press belt disclosed in Japanese Patent No. 2889341, the front-surface elastic layer is made of polyurethane containing no fiber. Therefore, if cracks are generated, the cracks tend to spread. Moreover, in the case where drain grooves are formed in the front-surface elastic layer, the groove shape cannot be firmly maintained, and the grooves tend to be deformed.

It is possible to strength the polyurethane layer by dispersing fibers in the polyurethane layer, as taught in Japanese Patent Publication No. H03-75673 of examined applications and Japanese Patent Publication No. H10-77593 of unexamined applications.

However, the problem is that containing fibers in the polyurethane layer increases the viscosity, and thus, voids may remain in the base fabric when the base fabric is impregnated with the fiber-containing polyurethane layer.

Moreover, as can be seen in Japanese Patent Publication No. H10-77593 of unexamined applications, orienting the fibers in the cross-machine direction (CD direction) increases the strength difference between the cross machine direction (CD direction) and a machine direction (MD direction), and cracks tend to be generated in the CD direction, and the generated cracks tend to spread in the CD direction.

Moreover, when long fibers are contained in the polyurethane layer, the fibers tend to get tangled each other, making it difficult to uniformly disperse the fibers. A portion where the fibers get tangled becomes a stress concentration point, causing generation of cracks, and the like.

DISCLOSURE OF THE INVENTION

It is an object of the present invention to provide a papermaking belt being free from voids and superior in terms of strength.

A papermaking belt according to the present invention includes: a base material layer including longitudinal and lateral yarns; a back-surface-side resin layer which is provided on a back surface side of the base material layer, and at least a part of which has penetrated into the base material layer from the back surface side of the base material layer; a first resin layer which has a relatively low viscosity, and has penetrated into the base material layer from a front surface side of the base material layer; and a second resin layer which contains chopped fibers in a dispersed state, has a higher viscosity than that of the first resin layer, and is provided on a front surface side of the first resin layer.

Examples of the base material including longitudinal and lateral yarns include a woven fabric, and a structure in which yarns are arranged in longitudinal and lateral directions. Since the papermaking belt includes the base material layer including longitudinal and lateral yarns, the strength in a machine direction (MD direction) and a cross-machine direction (CD direction) is increased, and extension in these directions can be suppressed. Since the blanket for an extended nip press disclosed in Japanese Patent Publication No. H03-75673 of examined applications does not include a base material layer such as a base fabric, this blanket has low strength in the MD direction and the CD direction, and is extended in these directions. Such extension often causes cracks.

The first resin layer penetrating into the base material layer from the front surface side of the base material layer has a relatively low viscosity. Therefore, the first resin layer easily penetrates into the base material layer including longitudinal and lateral yarns. Thus, no void is left in the base material layer.

Since the second resin layer provided on the front surface side of the first resin layer has a higher viscosity than that of the first resin layer, and contains chopped fibers in a dispersed state, the strength is improved. Moreover, even if cracks are generated, spreading of the cracks can be suppressed by the chopped fibers. Moreover, in the case where drain grooves are formed in the surface of the second resin layer, the groove shape can be firmly maintained.

Preferably, the chopped fibers in the second resin layer are randomly oriented. Randomly orienting the chopped fibers eliminates the strength difference among the MD direction, the CD direction, and a thickness direction, whereby generation and spreading of cracks can be suppressed.

A preferable length of the chopped fibers is in a range of 0.01 mm to 3 mm. If the length of the chopped fibers exceeds 3 mm, the fibers get tangled each other, inhibiting uniform dispersion of the fibers. Moreover, a portion where the fibers get tangled becomes a stress concentration point which causes generation of cracks, and the like. If the length of the chopped fibers is less than 0.01 mm, the reinforcing effect resulting from containing the fibers is less likely to be obtained. A more preferable length of the chopped fibers is in a range of 0.1 mm to 2 mm.

A content of the chopped fibers in the second resin layer is preferably in a range of 0.5% to 10% by mass. If the chopped fiber content exceeds 10%, the resin has an increased viscosity, and thus, has no flowability, causing a handling problem. If the chopped fiber content is lower than 0.5%, the reinforcing effect resulting from containing the fibers is less likely to be obtained.

In order to uniformly disperse the chopped fibers in the second resin layer, it is preferable to use chopped fibers subjected to a dispersive treatment, that is, RFL-treated or silanized chopped fibers. The use of such chopped fibers can eliminate tangling of the fibers. RFL treatment or silanization also improves the adhesive property between the chopped fibers and the resin.

In one embodiment, no fiber is contained in the first resin layer in order to facilitate penetration of the first resin layer into the base material layer. The first resin layer containing no fiber has a reduced viscosity, whereby the first resin layer penetrates into the base material layer in a desirable manner, and prevents voids from remaining in the base material layer. As another embodiment, fibers may be contained in the first resin layer to such a degree that can suppress the viscosity of the first resin layer to a low value.

Polyurethane is preferable as a material of the papermaking belt, in terms of strength and water resistance. In a preferred embodiment, the first and second resin layers are made of polyurethane.

BEST MODE FOR CARRYING OUT THE INVENTION

Figure 1:
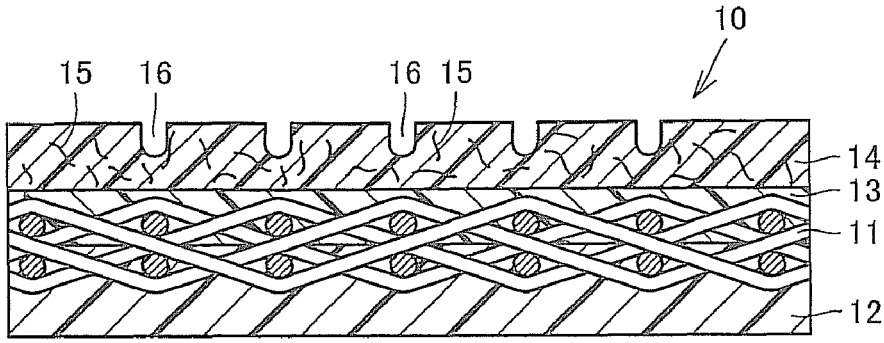
FIG. 1 is a cross-sectional view of a papermaking belt according to an embodiment of the present invention.

FIG. 1 is a cross-sectional view of a papermaking belt according to an embodiment of the present invention. A papermaking belt 10 of the present embodiment is a shoe press belt for use in a pressing/dehydrating process of a wet paper web. The papermaking belt 10 includes: a base material layer 11; a back-surface-side resin layer 12 which is provided on the back surface side of the base material layer, and at least a part of which has impregnated into the base material layer from the back surface side of the base material layer 11; a first resin layer 13 which has a relatively low viscosity, and has impregnated into the base material layer 11 from the front surface side of the base material layer; and a second resin layer 14 provided on the front surface side of the first resin layer 13.

The base material layer 11 includes longitudinal and lateral yarns. Since the papermaking belt 10 contains the base material layer 11 inside, the strength in a machine direction (MD direction) and a cross-machine direction (CD direction) increases, whereby extension in these directions can be suppressed.

The first resin layer 13 and the second resin layer 14 are preferably made of polyurethane. The first resin layer 13 is made to have a low viscosity so that it can impregnate into the base material layer 11 in a desirable manner without leaving any void in the base material layer. An example of a method for reducing the viscosity is to form the first resin layer 13 containing no fiber. Alternatively, the first resin layer 13 may contain a small amount of fibers if the viscosity can be reduced to such a level that the first resin layer 13 can impregnate into the base material layer 11 in a desirable manner. The first resin layer 13 is formed to such a height that the front surface side of the base material layer 11 is completely embedded.

The second resin layer 14 has a higher viscosity than that of the first resin layer 13, and contains chopped fibers 15 in a dispersed state. Since the second resin layer 14 contains uniformly dispersed chopped fibers 15, the strength of the second resin layer 14 is increased. Moreover, even if cracks are generated in the second resin layer 14, spreading of the cracks can be suppressed by the chopped fibers 15.

In the embodiment shown in FIG. 1, a multiplicity of drain grooves 16 extending along a belt travel direction are formed in the surface of the second resin layer 14. Since the second resin layer 14 contains the chopped fibers 15, the shape of the drain grooves 16 is firmly maintained, whereby an excellent draining property can be maintained.

In order to eliminate the strength difference among the MD direction, the CD direction, and a thickness direction, it is preferable that the chopped fibers 15 in the second resin layer 14 be randomly oriented. Such random orientation of the chopped fibers 15 can effectively suppress generation and spreading of cracks.

Moreover, in order to uniformly disperse the chopped fibers 15, it is preferable to use chopped fibers subjected to a dispersive treatment, that is, RFL-treated or silanized chopped fibers. The use of such chopped fibers can eliminate tangling of the fibers.

From the standpoint of eliminating tangling of the fibers, a preferable length of the chopped fibers is in the range of 0.01 mm to 3 mm. A more preferable range is 0.1 mm to 2 mm.

The content of the chopped fibers 15 is preferably in the range of 0.5% to 10% by mass. If the chopped fiber content exceeds 10%, the viscosity of the second resin layer 14 becomes too high, causing a handling problem. On the other hand, if the chopped fiber content is lower than 0.5%, the reinforcing effect resulting from containing the fibers is less likely to be obtained.

A preferable material of the chopped fibers 15 for improving the strength is a para aromatic polyamide. Other examples of the fibers include meta aromatic polyamide fibers, polyarylate fibers, polyketone fibers, polybenzazole fibers, ceramic fibers, glass fibers, graphite, ultra high molecular weight polyethylene, carbon fibers, and the like.

Figure 2:
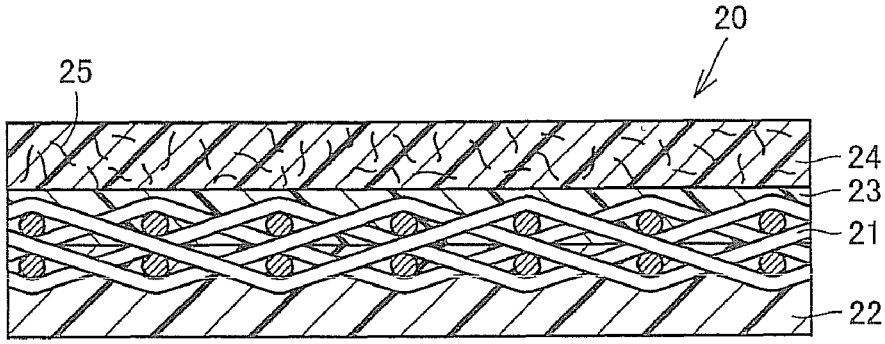
FIG. 2 is a cross-sectional view of a papermaking belt according to another embodiment of the present invention.

FIG. 2 is a cross-sectional view of a papermaking belt according to another embodiment of the present invention. Like the embodiment shown in FIG. 1, a papermaking belt 20 shown in the figure includes a base material layer 21, a back-surface-side resin layer 22, a first resin layer 23, and a second resin layer 24 having chopped fibers 25 uniformly dispersed therein. The embodiment of FIG. 2 is different from the embodiment of FIG. 1 only in that the second resin layer 24 has no drain groove. Since the structure is otherwise the same, detailed description thereof will be omitted.

Although the embodiments of the present invention were described above with reference to the figures, the present invention is not limited to the illustrated embodiments. Various modifications and variations can be made to the above illustrated embodiments within the same scope as, or an equivalent scope to, the present invention.

INDUSTRIAL APPLICABILITY

The present invention can be advantageously used as a high-strength papermaking belt having no void remaining therein, and having excellent crack resistance.

The invention claimed is:

1. A papermaking belt, comprising:

a base material layer including longitudinal and lateral yarns;

a back-surface-side resin layer which is provided on a back surface side of said base material layer, and at least a part of which is impregnated into said base material layer from said back surface side of said base material layer;

a first resin layer, comprising a resin having a relatively low viscosity, being impregnated into said base material layer from a front surface side of said base material layer, wherein said first resin layer does not contain fibers; and a second resin layer containing dispersed chopped fibers and comprising a resin having a higher viscosity than that of said resin of said first resin layer, said second resin layer provided on a front surface side of said first resin layer, wherein a length of said chopped fibers is in a range of 0.01 mm to 3 mm.

2. The papermaking belt according to claim 1, wherein said chopped fibers are randomly oriented in said second resin layer.

3. The papermaking belt according to claim 1, wherein said length of said chopped fibers is in a range of 0.1 mm to 2 mm.

4. The papermaking belt according to claim 1, wherein a content of said chopped fibers in said second resin layer is in a range of 0.5% to 10% by mass.

5. The papermaking belt according to claim 1, wherein said chopped fibers are RFL-treated or silanized chopped fibers.

6. The papermaking belt according to claim 1, wherein said first and second resin layers are made of polyurethane.

* * * * *